US009744778B2

(12) United States Patent
Aoike et al.

(10) Patent No.: US 9,744,778 B2
(45) Date of Patent: Aug. 29, 2017

(54) IMAGE RECORDING APPARATUS AND IMAGE RECORDING METHOD

(71) Applicant: SCREEN HOLDINGS CO., LTD., Kyoto (JP)

(72) Inventors: Masaaki Aoike, Kyoto (JP); Tamio Fukui, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/021,233

(22) PCT Filed: Aug. 12, 2014

(86) PCT No.: PCT/JP2014/071259

§ 371 (c)(1),
(2) Date: Mar. 10, 2016

(87) PCT Pub. No.: WO2015/040983

PCT Pub. Date: Mar. 26, 2015

(65) Prior Publication Data

US 2016/0221362 A1 Aug. 4, 2016

(30) Foreign Application Priority Data

Sep. 20, 2013 (JP) ..... 2013-195180

(51) Int. Cl.
*B41J 11/00* (2006.01)
*B41J 2/155* (2006.01)

(52) U.S. Cl.
CPC ..... *B41J 11/002* (2013.01); *B41J 2/155* (2013.01)

(58) Field of Classification Search
CPC ..... B41J 11/002
See application file for complete search history.

(56) References Cited

U.S. PATENT DOCUMENTS

2010/0182378 A1* 7/2010 Mitsuzawa ..... B41J 2/145 347/51
2011/0001783 A1 1/2011 Fujisawa
(Continued)

FOREIGN PATENT DOCUMENTS

CN 101941331 A 1/2011
JP 2004-167847 A 6/2004
(Continued)

OTHER PUBLICATIONS

International Search Report issued in PCT/JP2014/071259, dated Nov. 18, 2014.
(Continued)

*Primary Examiner* — Geoffrey Mruk
(74) *Attorney, Agent, or Firm* — McDermott Will & Emery LLP

(57) ABSTRACT

This image recording apparatus includes a viscosity increasing light irradiator that increases the viscosity of ink ejected onto a recording medium, and a fixing light irradiator that fixes the ink on the recording medium. The fixing light irradiator is disposed behind a first switching part that causes the transport orientation of the recording medium to approach the vertical. This reduces the footprint of the image recording apparatus. Also a second type of irradiation light emitted from the fixing light irradiator is intercepted by the recording medium. This suppresses the unwanted curing of the ink in an image recorder. Also the viscosity increasing light irradiator is disposed at a location upstream from the first switching part in a transport direction. This suppresses the decrease in printing quality resulting from the passage of the ink remaining uncured through the first switching part.

7 Claims, 5 Drawing Sheets

(56) References Cited

U.S. PATENT DOCUMENTS

| | | | | |
|---|---|---|---|---|
| 2012/0160114 | A1* | 6/2012 | Otto | B41M 1/00<br>101/211 |
| 2014/0210920 | A1* | 7/2014 | Kanada | B41J 15/04<br>347/102 |

FOREIGN PATENT DOCUMENTS

| | | | |
|---|---|---|---|
| JP | 2011-011470 | A | 1/2011 |
| JP | 2012-081694 | A | 4/2012 |
| JP | 2012-196785 | A | 10/2012 |
| JP | 2014-144565 | A | 8/2014 |

OTHER PUBLICATIONS

Notice of Reasons for Refusal issued in corresponding Japanese Patent Application No. 2013-195180, dated Dec. 5, 2016.

* cited by examiner

IMAGE RECORDING APPARATUS AND IMAGE RECORDING METHOD

CROSS REFERENCE

This application is the U.S. National Phase under 35 U.S.C. §371 of International Application No. PCT/JP2014/071259, filed on Aug. 12, 2014, which claims the benefit of Japanese Application No. 2013-195180, filed on Sep. 20, 2013, the entire contents of each are hereby incorporated by reference.

TECHNICAL FIELD

The present invention relates to an image recording apparatus and an image recording method which use photo-curable inks to record an image on a recording medium while transporting the recording medium in a transport direction along the longitudinal direction of the recording medium.

BACKGROUND ART

An inkjet image recording apparatus which records an image on a strip-shaped recording medium by ejecting photo-curable inks from a plurality of recording heads while transporting the recording medium has heretofore been known. In the image recording apparatus of this type, inks are ejected onto a recording surface of the recording medium, and are thereafter cured by irradiating the recording medium with light such as ultraviolet rays. Thus, the inks are fixed on the recording surface of the recording medium.

Conventional image recording apparatuses employing photo-curable inks are disclosed in Patent Literature 1 and Patent Literature 2, for example.

CITATION LIST

Patent Literature

Patent Literature 1: Japanese Patent Application Laid-Open No. 2004-167847

Patent Literature 2: Japanese Patent Application Laid-Open No. 2012-81694

SUMMARY OF INVENTION

Technical Problem

In the image recording apparatuses employing photo-curable inks, there are cases in which the inks adhering to nozzles of the recording heads are cured when part of the light for curing the inks is reflected from the surface of the recording medium, for example, to leak toward the recording heads. Such curing of the inks in the recording heads becomes a factor in clogging of the nozzles.

In this regard, the apparatus of Patent Literature 1 includes a platen having steps formed by first opposed surfaces opposed to recording heads and second opposed surfaces opposed to irradiators. This prevents light reflected from the surface of the recording medium from impinging upon ink ejection orifices of the recording heads (FIG. 2). In the structure of Patent Literature 1, however, the recording medium is curved by the platen having the steps. As a result, there is apprehension that the spread of uncured inks is increased on the surface of the recording medium to result in the decrease in printing quality.

On the other hand, the apparatus of Patent Literature 2 includes a full curing light source unit and semi-curing LED assemblies. The semi-curing LED assemblies cure inks to such a degree that the shape of the inks having impacted on paper does not change (FIG. 1). The use of such semi-curing LED assemblies suppresses the spread of inks before full curing. However, the combined use of the full curing light source unit and the semi-curing LED assemblies as in Patent Literature 2 presents another problem in that a longer transport path results in an increase in footprint of the apparatus.

In view of the foregoing, it is an object of the present invention to provide an image recording apparatus and an image recording method which are capable of suppressing the unwanted curing of photo-curable ink in a recording head, suppressing the decrease in printing quality resulting from a change in transport orientation of a recording medium, and suppressing the increase in footprint of the apparatus.

Solution to Problem

To solve the aforementioned problem, a first aspect of the present invention is intended for an image recording apparatus comprising: a transport mechanism for transporting a recording medium in a transport direction along the longitudinal direction of the recording medium; at least one recording head including fixedly disposed nozzles, the at least one recording head ejecting a photo-curable ink from the nozzles onto a surface of the recording medium; a viscosity increasing light irradiator downstream from the at least one recording head in the transport direction, the viscosity increasing light irradiator irradiating the recording medium with a first type of irradiation light that increases the viscosity of the ink; and a fixing light irradiator downstream from the viscosity increasing light irradiator in the transport direction, the fixing light irradiator irradiating the recording medium with a second type of irradiation light that fixes the ink on the recording medium, the first type of irradiation light being smaller in amount of light than the second type of irradiation light, the transport mechanism including a first switching part between the viscosity increasing light irradiator and the fixing light irradiator, the first switching part changing the transport orientation of the recording medium so that the transport orientation approaches the vertical, and a second switching part downstream from the fixing light irradiator in the transport direction, the second switching part changing the transport orientation of the recording medium so that the transport orientation approaches the horizontal, the recording medium being transported in such a manner as to cross a line segment connecting the at least one recording head and the fixing light irradiator.

According to a second aspect of the present invention, in the image recording apparatus of the first aspect, the ink is an ultraviolet ray curable ink, and the viscosity increasing light irradiator and the fixing light irradiator emit light including ultraviolet rays.

According to a third aspect of the present invention, in the image recording apparatus of the first or second aspect, the viscosity increasing light irradiator includes an LED light source, and the first type of irradiation light is emitted from the LED light source.

According to a fourth aspect of the present invention, in the image recording apparatus of any one of the first to third aspects, the first switching part changes the transport orientation of the recording medium to a vertical downward orientation.

According to a fifth aspect of the present invention, in the image recording apparatus of any one of the first to fourth aspects, the at least one recording head includes a plurality of recording heads; the viscosity increasing light irradiator includes a single viscosity increasing light irradiator; and the single viscosity increasing light irradiator is disposed at a location downstream from the most downstream one of the recording heads in the transport direction.

According to a sixth aspect of the present invention, in the image recording apparatus of the fifth aspect, the most downstream one of the recording heads in the transport direction is a recording head for ejecting a black ink.

A seventh aspect of the present invention is intended for a method of recording an image on a recording medium while transporting the recording medium in a transport direction along the longitudinal direction of the recording medium. The method comprises the steps of: a) ejecting a photo-curable ink from fixedly disposed nozzles onto a surface of the recording medium; b) irradiating the recording medium with a first type of irradiation light that increases the viscosity of the ink, the step b) being performed after the step a); c) changing the transport orientation of the recording medium so that the transport orientation approaches the vertical, the step c) being performed after the step b); d) irradiating the recording medium with a second type of irradiation light that fixes the ink on the recording medium, the step d) being performed after the step c); and e) changing the transport orientation of the recording medium so that the transport orientation approaches the horizontal, the step e) being performed after the step d), the first type of irradiation light being smaller in amount of light than the second type of irradiation light, the recording medium being transported in such a manner as to cross a line segment connecting the recording head and the fixing light irradiator.

According to an eighth aspect of the present invention, in the method of recording an image of the seventh aspect, the ink is an ultraviolet ray curable ink; light including ultraviolet rays is emitted as the first type of irradiation light in the step b); and light including ultraviolet rays is emitted as the second type of irradiation light in the step d).

According to a ninth aspect of the present invention, in the method of recording an image of the seventh or eighth aspect, the first type of irradiation light is emitted from an LED light source in the step b).

According to a tenth aspect of the present invention, in the method of recording an image of any one of the seventh to ninth aspects, the transport orientation of the recording medium is changed to a vertical downward orientation in the step c).

According to an eleventh aspect of the present invention, in the method of recording an image of any one of the seventh to tenth aspects, the photo-curable ink is emitted from the nozzles provided in a plurality of recording heads onto the surface of the recording medium in the step a), and the recording medium is irradiated with the first type of irradiation light at a location downstream from the most downstream one of the recording heads in the transport direction in the step b).

According to a twelfth aspect of the present invention, in the method of recording an image of the eleventh aspect, the most downstream one of the recording heads in the transport direction is a recording head for ejecting a black ink.

Advantageous Effects of Invention

According to the first to sixth aspects of the present invention, the fixing light irradiator is disposed between the first switching part and the second switching part. This reduces the footprint of the apparatus. Also, the second type of irradiation light emitted from the fixing light irradiator, which is intercepted by the recording medium, is less prone to reach the recording head. Thus, the unwanted curing of the ink in the recording head is suppressed. Also, the first type of irradiation light is disposed at a location upstream from the first switching part in the transport direction to increase the viscosity of the ink. This suppresses the decrease in printing quality resulting from the passage of the ink remaining uncured through the first switching part.

According to the seventh to twelfth aspects of the present invention, the recording medium is irradiated with the second type of irradiation light, with the transport orientation of the recording medium approaching the vertical. This reduces the footprint of the apparatus. The second type of irradiation light emitted in the step d), which is intercepted by the recording medium, is less prone to reach the recording head. Thus, the unwanted curing of the ink in the recording head is suppressed. The first type of irradiation light increases the viscosity of the ink before the transport orientation of the recording medium is changed. This suppresses the decrease in printing quality resulting from the change in transport orientation of the recording medium, with the ink remaining uncured.

In particular, according to the third and ninth aspects of the present invention, the use of the LED light source achieves irradiation with light of a narrow wavelength band. Also, the generation of heat resulting from the irradiation with light is suppressed, so that the influence of deterioration of the ink and the like due to heat is suppressed.

In particular, according to the fourth aspect of the present invention, the recording medium is transported in the vertical downward orientation between the first switching part and the second switching part. This further reduces the footprint of the apparatus.

In particular, according to the fifth aspect of the present invention, the footprint of the apparatus is further reduced as compared with an instance in which viscosity increasing light irradiators are disposed at a plurality of locations.

In particular, according to the sixth and twelfth aspects of the present invention, the black ink is irradiated with the first type of irradiation light immediately after the ejection of the black ink. This suppresses the spread of the black ink having especially great influence on printing quality on the surface of the recording medium.

In particular, according to the tenth aspect of the present invention, the recording medium is transported in the vertical downward orientation in the step d). This further reduces the footprint of the apparatus.

In particular, according to the eleventh aspect of the present invention, the footprint of the apparatus is further reduced as compared with an instance in which the first type of irradiation light is emitted at a plurality of locations.

DESCRIPTION OF EMBODIMENTS

An embodiment according to the present invention will now be described with reference to the drawings.

<1. Configuration of Image Recording Apparatus>

Figure 1:
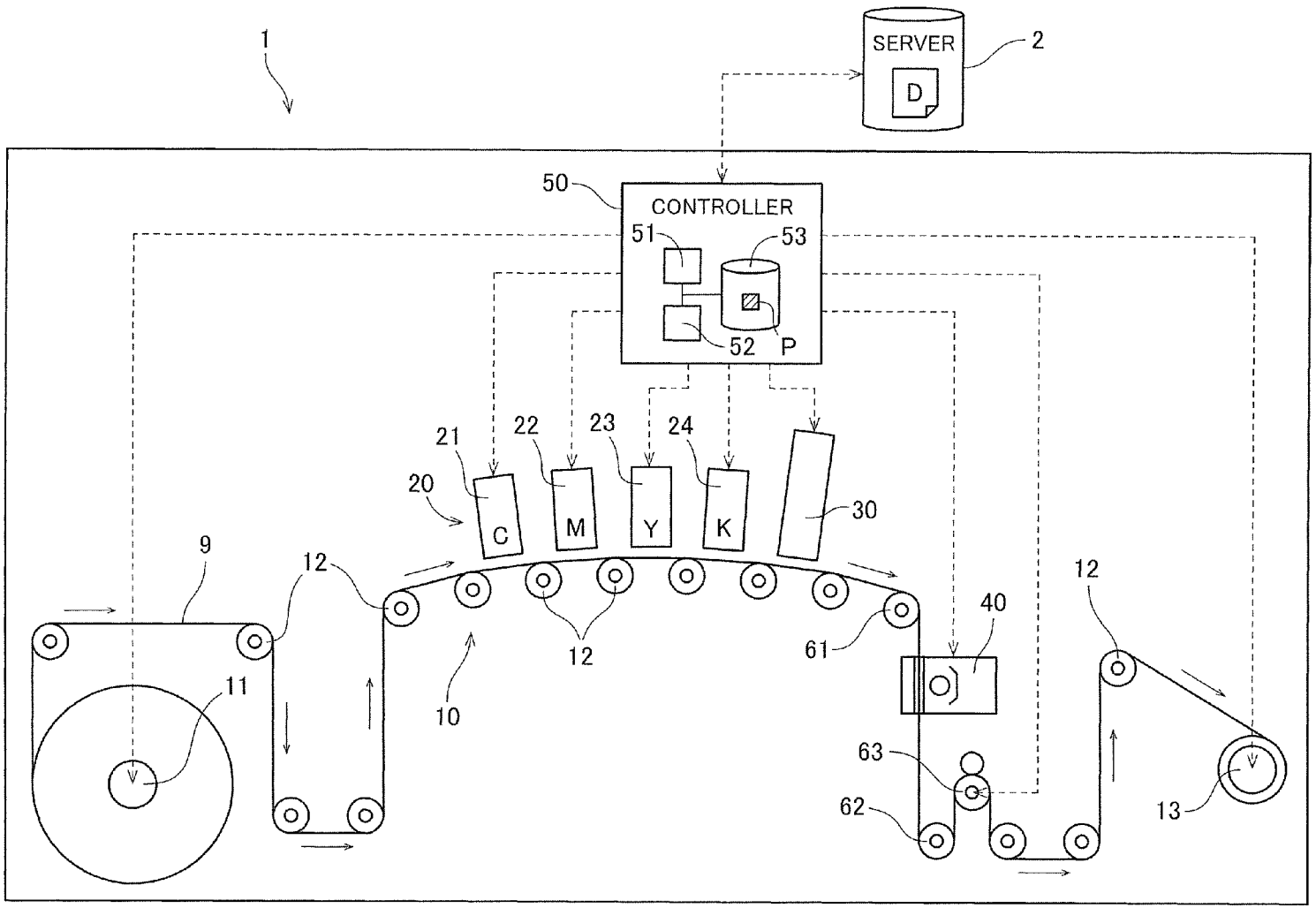
FIG. 1 is a view showing a configuration of an image recording apparatus.

FIG. 1 is a view showing a configuration of an image recording apparatus 1 according to one embodiment of the present invention. This image recording apparatus 1 is an inkjet printing apparatus which records a color image on printing paper 9 that is a strip-shaped recording medium by ejecting inks from a plurality of head units 21 to 24 onto the printing paper 9 while transporting the printing paper 9. As shown in FIG. 1, the image recording apparatus 1 includes a transport mechanism 10, an image recorder 20, a viscosity increasing light irradiator 30, a fixing light irradiator 40, and a controller 50.

The transport mechanism 10 is a mechanism for transporting the printing paper 9 in a transport direction along the longitudinal direction of the printing paper 9. The transport mechanism 10 according to the present embodiment includes an unwinder 11, a plurality of transport rollers 12, and a winder 13. The transport rollers 12 include a first switching roller 61, a second switching roller 62, and nip rollers 63 to be described later. The printing paper 9 is unwound from the unwinder 11, and is transported along a transport path formed by the transport rollers 12. Each of the transport rollers 12 rotates about a horizontal axis to guide the printing paper 9 downstream along the transport path. The transported printing paper 9 is wound and collected on the winder 13.

As shown in FIG. 1, the printing paper 9 is moved substantially horizontally under the image recorder 20 in a direction in which the head units 21 to 24 are arranged. During this movement, a recording surface of the printing paper 9 faces upwardly (toward the head units 21 to 24). The transport mechanism 10 includes the first switching roller 61, the second switching roller 62, and the nip rollers 63 which are downstream from the image recorder 20 along the transport path.

The nip rollers 63 rotate actively at a constant speed while holding the printing paper 9 therebetween in contact with the opposite surfaces of the printing paper 9. During the transport of the printing paper 9, the controller 50 adjusts the rotation speed of the unwinder 11 with respect to the rotation speed of the nip rollers 63. This applies tension to the printing paper 9. As a result, slack and wrinkles in the printing paper 9 are prevented during the transport.

The image recorder 20 is a mechanism for ejecting ultraviolet ray curable inks toward the printing paper 9 transported by the transport mechanism 10. The image recorder 20 according to the present embodiment includes the four head units 21 to 24. The four head units 21 to 24 eject ink droplets of respective colors, i.e. C (Cyan), M (Magenta), Y (Yellow) and K (Black), which are color components of a color image onto the recording surface of the printing paper 9. The head units 21 to 24 are disposed fixedly with respect to a frame of the image recording apparatus 1.

Figure 2:
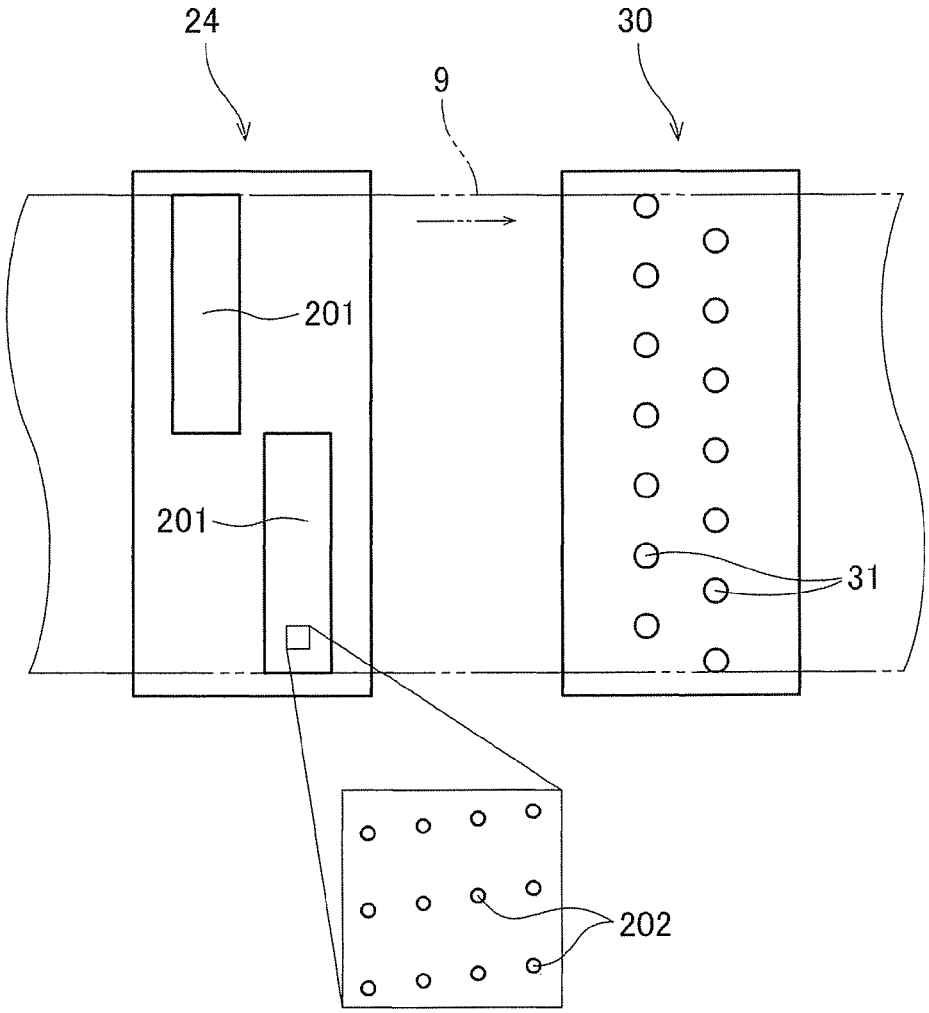
FIG. 2 is a bottom plan view of a head unit and a viscosity increasing light irradiator.

FIG. 2 is a bottom plan view of the head unit 24 and the viscosity increasing light irradiator 30. As shown in FIG. 2, the head unit 24 according to the present embodiment includes two recording heads 201. As shown on an enlarged scale in FIG. 2, the lower surface of each of the recording heads 201 has nozzles 202 arranged in a regular alignment. Similarly, each of the three remaining head units 21 to 23 includes two recording heads 201 having nozzles 202. At the time of printing, ink droplets of each color are ejected from the nozzles 202 of each of the head units 21 to 24 toward the recording surface of the printing paper 9. Thus, a color image is recorded on the recording surface of the printing paper 9.

The viscosity increasing light irradiator 30 is a mechanism for irradiating the printing paper 9 with a first type of irradiation light at a location downstream from the image recorder 20 in the transport direction. As shown in FIG. 2, the lower surface of the viscosity increasing light irradiator 30 includes a plurality of LED (Light Emitting Diode) light sources 31 arranged in a regular alignment. In the example of FIG. 2, the LED light sources 31 are arranged two-dimensionally in the transport direction and in a width direction (a horizontal direction orthogonal to the transport direction). However, the LED light sources 31 may be arranged in a line in the width direction.

The first type of irradiation light emitted from the respective LED light sources 31 includes ultraviolet rays of a wavelength band effective in curing the inks ejected from the head units 21 to 24. Thus, the irradiation of the inks on the printing paper 9 with the first type of irradiation light increases the viscosity of the inks. It should be noted that the first type of irradiation light emitted from the viscosity increasing light irradiator 30 is smaller in amounts of light than a second type of irradiation light emitted from the fixing light irradiator 40. Thus, the inks on the printing paper 9 are not completely cured. In other words, the inks of the respective colors on the printing paper 9 are in a semi-cured state with a low fluidity resulting from irradiation of the first type of irradiation light.

When the inks are semi-cured, the spread of the inks on the printing paper 9 is suppressed. Thus, the decrease in printing quality resulting from the spread of the inks is less prone to occur in the transport path downstream from the viscosity increasing light irradiator 30.

In the present embodiment, the head unit 24 for ejecting a black ink is disposed at the most downstream location of the four head units 21 to 24 of the image recorder 20 in the transport direction. Immediately after the black ink is ejected from the head unit 24, the first type of irradiation light is emitted from the viscosity increasing light irradiator 30. This effectively suppresses the spread of the black ink having especially great influence on printing quality on the recording surface of the printing paper 9.

In the present embodiment, the viscosity increasing light irradiator 30 is disposed in proximity to the head unit 24. However, the leakage of the first type of irradiation light, if any, toward the head unit 24 exerts little influence on the head unit 24 because the first type of irradiation light emitted from the viscosity increasing light irradiator 30 is small in amounts of light. Thus, a problem such that light leaking from the viscosity increasing light irradiator 30 cures the ink in the head unit 24 to cause the clogging of the nozzles 202 is less prone to arise. In particular, the LED light sources 31 are used as light sources for the viscosity increasing light irradiator 30 in the present embodiment. The LED light sources 31 are narrower in wavelength band of irradiation light and smaller in the amount of heat resulting from light irradiation than a metal halide lamp 41 for use in the fixing light irradiator 40. This further reduces the influence on the head unit 24 in proximity to the viscosity increasing light irradiator 30.

In this manner, the viscosity increasing light irradiator 30 may be disposed in proximity to the head unit 24. This suppresses the increase in footprint (floor area) of the image recording apparatus 1 due to the installation of the viscosity increasing light irradiator 30.

Referring again to FIG. 1, the first switching roller 61 serving as a first switching part is disposed between the viscosity increasing light irradiator 30 and the fixing light irradiator 40. The first switching roller 61 rotates while being in contact with the back surface of the printing paper 9. This changes the transport orientation of the printing paper 9 from a substantially horizontal orientation to a vertical downward orientation.

The printing paper 9 is curved largely at the first switching roller 61 when the transport orientation of the printing paper 9 is changed. If the inks adhering to the printing paper 9 are uncured, there is apprehension that the spread of the inks results in the decrease in printing quality. In the image recording apparatus 1 according to the present embodiment, however, the inks on the printing paper 9 are in a semi-cured state when passing over the first switching roller 61. This suppresses the spread of the ink at the first switching roller 61.

The first switching roller 61 according to the present embodiment contacts the back surface of the printing paper 9, rather than the recording surface of the printing paper 9. For this reason, the surface of the first switching roller 61 does not contact the inks in the semi-cured state. This further suppresses the decrease in printing quality at the first switching roller 61.

Figure 3:
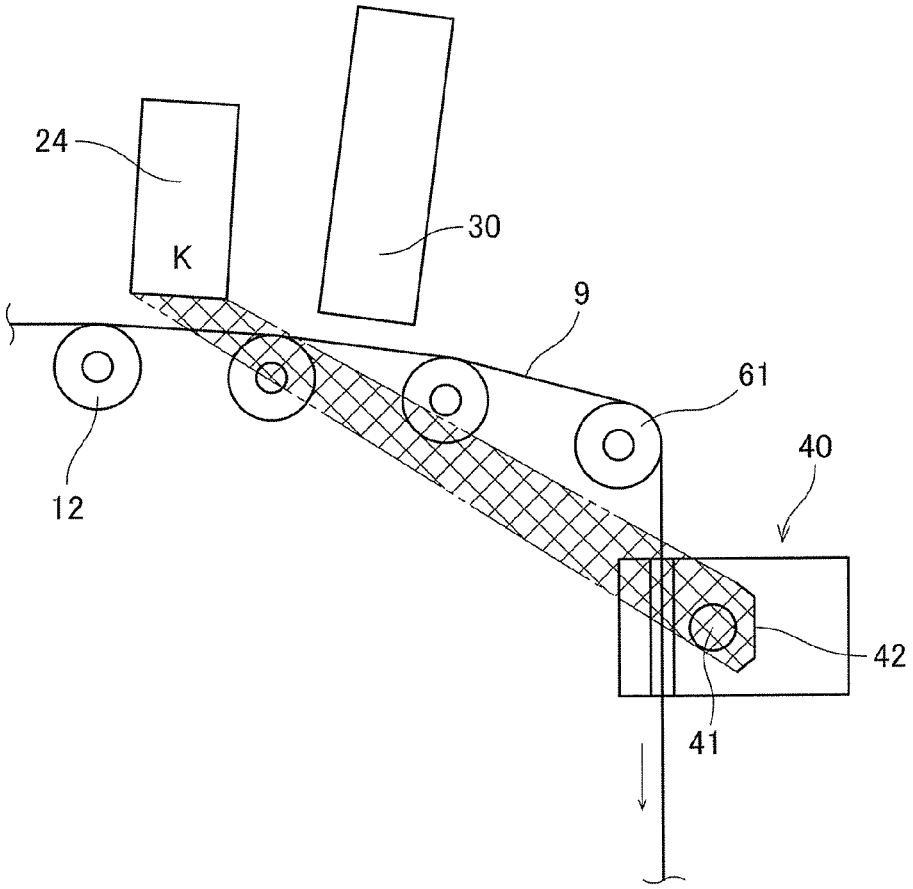
FIG. 3 is a view showing a configuration extending from the head unit to a fixing light irradiator.

The fixing light irradiator 40 is a mechanism for irradiating the printing paper 9 with the second type of irradiation light at a location downstream from the first switching roller 61 in the transport direction, i.e. vertically below the first switching roller 61. FIG. 3 is a view showing a configuration extending from the head unit 24 to the fixing light irradiator 40. As shown in FIG. 3, the fixing light irradiator 40 according to the present embodiment includes the metal halide lamp 41 and a reflector 42. The metal halide lamp 41 is a tubular light source extending in the width direction of the printing paper 9.

The second type of irradiation light emitted from the metal halide lamp 41 includes ultraviolet rays of a wavelength band effective in curing the inks ejected from the head units 21 to 24. Also, the second type of irradiation light emitted from the metal halide lamp 41 is sufficient in amounts of light for completely curing the inks. Thus, the irradiation of the inks on the printing paper 9 with the second type of irradiation light cures the inks to fix the inks on the recording surface of the printing paper 9.

The fixing light irradiator 40 emits the second type of irradiation light toward the printing paper 9 transported in the vertical downward orientation between the first switching roller 61 and the second switching roller 62. If the transport orientation of the printing paper 9 is not changed between the image recorder 20 and the fixing light irradiator 40, part of the second type of irradiation light emitted from the fixing light irradiator 40 is liable to exert influence on the image recorder 20. In that case, it is necessary that the fixing light irradiator 40 is placed far away from the image recorder 20.

However in the image recording apparatus 1, the transport orientation of the printing paper 9 is changed to the vertical downward orientation between the image recorder 20 and the fixing light irradiator 40. Thus, light leaking from the fixing light irradiator 40 is less prone to reach the image recorder 20. This suppresses the problem that the inks in the respective head units 21 to 24 are cured to cause the clogging of the nozzles 202. Such a configuration reduces the footprint of the image recording apparatus 1 without the need to place the fixing light irradiator 40 far away from the image recorder 20.

In particular, the printing paper 9 is transported in this image recording apparatus 1 in such a manner as to cross a line segment connecting the most downstream head unit 24 and the fixing light irradiator 40, as shown in FIG. 3. More specifically, the printing paper 9 is transported in such a manner as to cross a line segment connecting any point lying on the lower surface serving as an ejection surface of the head unit 24 and any point lying in the metal halide lamp 41 or the reflector 42 of the fixing light irradiator 40 (a line segment contained in a cross-hatched area in FIG. 3). Thus, the second type of irradiation light emitted from the metal halide lamp 41 or the second type of irradiation light reflected from the reflector 42 is intercepted by the printing paper 9, and does not reach the head units 21 to 24. Thus, the unwanted curing of the inks in the head units 21 to 24 is suppressed.

Referring again to FIG. 1, the second switching roller 62 serving as a second switching part is disposed at a location downstream from the fixing light irradiator 40 in the transport direction. The second switching roller 62 rotates while being in contact with the front surface of the printing paper 9. This changes the transport orientation of the printing paper 9 so that the transport orientation approaches the horizontal. After passing over the second switching roller 62, the printing paper 9 passes between the nip rollers 63 and over the transport rollers 12, and is wound and collected on the winder 13.

The controller 50 is a means for controlling the operations of the respective components in the image recording apparatus 1. The controller 50 according to present embodiment includes a computer having an arithmetic processor 51 such as a CPU, a memory 52 such as a RAM, and a storage part 53 such as a hard disk drive. As indicated by broken lines in FIG. 1, the controller 50 is electrically connected to the unwinder 11, the winder 13, the four head units 21 to 24, the viscosity increasing light irradiator 30, the fixing light irradiator 40, and the nip rollers 63 described above. The controller 50 temporarily reads a computer program P stored in the storage part 53 onto the memory 52. The arithmetic processor 51 performs arithmetic processing based on the computer program P, so that the controller 50 controls the operations of the aforementioned components. Thus, the printing process in the image recording apparatus 1 proceeds.

The controller 50 is also electrically connected to a server 2 provided outside the image recording apparatus 1. Image data D to be printed is stored in the server 2. For the printing process, the transport mechanism 10 transports the printing paper 9, and the controller 50 reads a designated piece of image data D from the server 2, so that the head respective units 21 to 24 eject the inks of the respective colors, based on the designated piece of image data D. As a result, an image corresponding to the designated piece of image data D is recorded on the recording surface of the printing paper 9.

<2. Printing Process>

Figure 4:
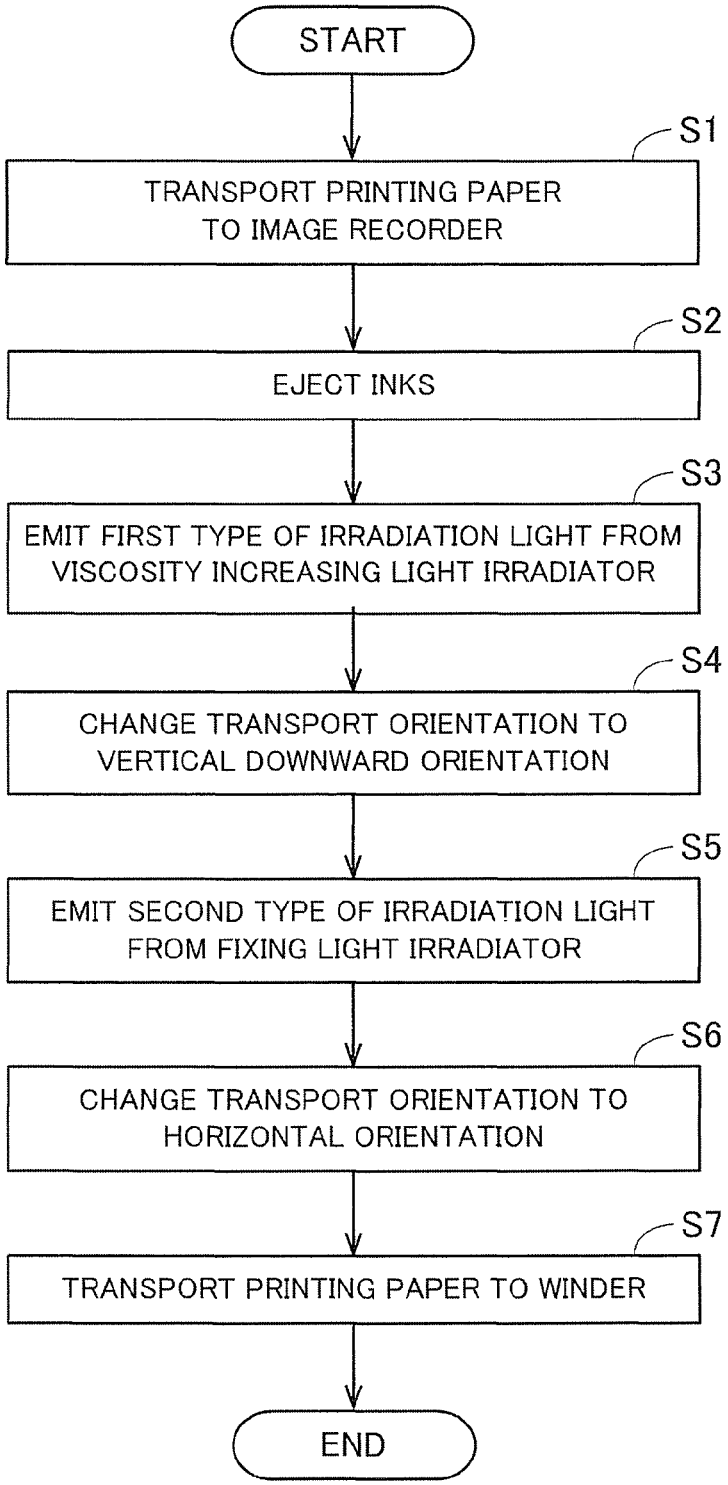
FIG. 4 is a flow diagram showing a procedure for a printing process.

Next, the printing process in the aforementioned image recording apparatus 1 will be described. For the printing process in the image recording apparatus 1, the printing paper 9 is continuously transported from the unwinder 11 toward the winder 13. Processes including ink ejection, light irradiation and the like are performed sequentially on portions of the printing paper 9 along the longitudinal direction thereof. FIG. 4 is a flow diagram showing a procedure of the processes sequentially performed on a portion (referred to hereinafter as a "target portion") of the printing paper 9 along the longitudinal direction thereof on which attention is focused.

First, the target portion of the printing paper 9 is unwound from the unwinder 11, and is transported to under the image recorder 20 while being guided by the transport rollers 12 (Step S1). When the target portion comes to under the image recorder 20, the image recorder 20 ejects ink droplets of the respective colors from the nozzles 202 of the respective head units 21 to 24 toward the recording surface of the target portion (Step S2). Thus, a color image is formed on the recording surface of the target portion. As mentioned above, the inks ejected in Step S2 are ultraviolet ray curable inks.

After the target portion of the printing paper 9 passes under the image recorder 20, the viscosity increasing light irradiator 30 emits the first type of irradiation light toward the recording surface of the target portion (Step S3). In this step, the target portion of the printing paper 9 passes under the LED light sources 31 remaining lit continuously. This increases the viscosity of the inks adhering to the recording surface of the target portion to place the inks in a semi-cured state.

Subsequently, the target portion of the printing paper 9 passes over the first switching roller 61. Thus, the transport orientation of the target portion is changed from a substantially horizontal orientation to a vertical downward orientation (Step S4). At this time, the target portion of the printing paper 9 is curved largely. However, the decrease in printing quality resulting from the spread of the inks is less prone to occur because the inks adhering to the target portion are in the semi-cured state.

Next, the fixing light irradiator 40 emits the second type of irradiation light toward the recording surface of the target portion (Step S5). In this step, the target portion of the printing paper 9 passes the front of the metal halide lamp 41 remaining lit continuously. This step cures the inks adhering to the recording surface of the target portion to fix the inks on the recording surface. The second type of irradiation light emitted from the fixing light irradiator 40, which is intercepted by the printing paper 9, does not reach the head units 21 to 24. Thus, the unwanted curing of the inks in the head units 21 to 24 is suppressed.

Next, the target portion of the printing paper 9 passes over the second switching roller 62. This changes the transport orientation of the target portion from the vertical downward orientation to an orientation closer to the horizontal (Step S6). At this time, the recording surface of the target portion comes in contact with the front surface of the second switching roller 62. However, the decrease in printing quality resulting from the contact with the second switching roller 62 is less prone to occur because the inks adhering to the target portion is completely cured.

Thereafter, the target portion of the printing paper 9 is transported while being guided by the nip rollers 63 and the transport rollers 12, and is wound and collected on the winder 13 (Step S7). This completes the printing process performed on the target portion of the printing paper 9.

<3. Modifications>

While the one embodiment according to the present invention has been described hereinabove, the present invention is not limited to the aforementioned embodiment.

Figure 5:
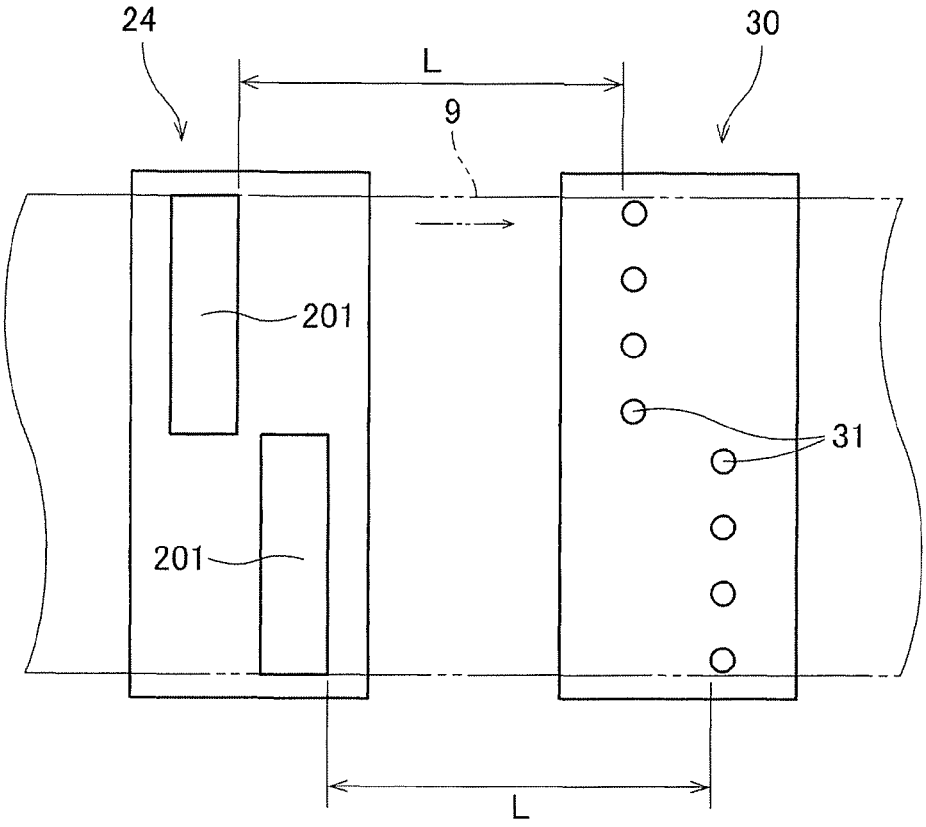
FIG. 5 is a bottom plan view of the head unit and the viscosity increasing light irradiator according to a modification.

FIG. 5 is a bottom plan view of the head unit 24 and the viscosity increasing light irradiator 30 according to a modification. In the modification of FIG. 5, the positions of the LED light sources 31 of the viscosity increasing light irradiator 30 as seen in the transport direction are set in accordance with the positions of the two recording heads 201 in the head unit 24 as seen in the transport direction. Specifically, a distance L between each of the recording heads 201 and the LED light sources 31 positioned downstream from each of the recording heads 201 in the transport direction is constant independently of the positions as seen in the width direction. This provides a substantially constant time interval between the ejection of the ink from each recording head 201 and the irradiation of the ink with the first type of irradiation light. Thus, variations in the spread of the ink on the printing paper 9 are less prone to occur.

In the aforementioned embodiment, the LED light sources are used as the light sources for the viscosity increasing light irradiator 30. However, other light sources may be used in place of the LED light sources. For example, a metal halide lamp smaller in amounts of light than the metal halide lamp 41 for use in the fixing light irradiator 40 may be used for the viscosity increasing light irradiator 30.

In the aforementioned embodiment, the ultraviolet ray curable inks are used as the inks ejected from the image recorder 20. However, photo-curable inks cured by light (for example, visible light) other than ultraviolet rays may be used.

In the aforementioned embodiment, the first switching roller 61 changes the transport orientation of the printing paper 9 to the vertical downward orientation. However, the first switching part according to the present invention need not necessarily be configured to change the transport orientation of the recording medium precisely to the vertical downward orientation. That is, the first switching part according to the present invention may be configured to change the transport orientation of the recording medium so that the transport orientation approaches the vertical.

In the aforementioned embodiment, the image recorder 20 includes the four head units 21 to 24. However, the number of head units in the image recorder 20 may be in the range of one to three or not less than five. For example, a head unit for ejecting an ink of a spot color may be provided in addition to those for C, M, Y and K. Also, in the aforementioned embodiment, each of the head units 21 to 24 includes the two recording heads 201. However, the number of recording heads in each head unit may be one or not less than three.

In the aforementioned embodiment, the image recording apparatus 1 includes the single viscosity increasing light irradiator 30. However, the image recording apparatus 1 may include a plurality of viscosity increasing light irradiators 30. For example, the viscosity increasing light irradiators 30 may be provided closely behind the respective head units 21 to 24 as seen in the transport direction. This further shortens the time interval between the ejection of the inks and the semi-curing of the inks to thereby further suppress the decrease in printing quality resulting from the spread of the inks.

However, the provision of the single viscosity increasing light irradiator at a location downstream from the most downstream head unit 24 in the transport direction as in the aforementioned embodiment achieves the reduction in footprint of the image recording apparatus 1, as compared with the provision of the viscosity increasing light irradiators at a plurality of locations. It is therefore preferable to employ the structure of the aforementioned embodiment when greater importance is placed on the reduction in footprint.

In the aforementioned embodiment, the LED light sources 31 in the viscosity increasing light irradiator 30 are continuously lit with a constant amount of light. However, the controller 50 of the image recording apparatus 1 may control the amount of light from the LED light sources 31 in accordance with conditions. For example, the amount of light from the LED light sources 31 may be changed to an optimum amount, depending on the type of the printing paper 9 and the type of inks to be used. Alternatively, the amount of light from the LED light sources 31 may be controlled so as to increase when the inks are ejected in large amounts from the image recorder 20 and to decrease when the inks are ejected in small amounts from the image recorder 20.

The aforementioned image recording apparatus 1 records an image on the printing paper 9 that is a medium subjected to recording. However, the image recording apparatus according to the present invention may be configured to record an image on a strip-shaped recording medium other than general paper (for example, a film made of resin and the like).

The shapes of the details of the transport mechanism and the image recording apparatus may be different from those shown in the figures of the present invention. The respective components described in the aforementioned embodiment and in the modifications may be consistently combined together, as appropriate.

REFERENCE SIGNS LIST

1 Image recording apparatus
2 Server
9 Printing paper
10 Transport mechanism
11 Unwinder
12 Transport rollers
13 Winder
20 Image recorder
21-24 Head units
30 Viscosity increasing light irradiator
31 LED light sources
40 Fixing light irradiator
41 Metal halide lamp
42 Reflector
50 Controller
61 First switching roller
62 Second switching roller
63 Nip rollers
201 Recording heads
202 Nozzles
D Image data
P Computer program

The invention claimed is:

1. An image recording apparatus comprising:

a transport mechanism for transporting a recording medium in a transport direction along the longitudinal direction of the recording medium;

at least one recording head including fixedly disposed nozzles, the at least one recording head ejecting a photo-curable ink from the nozzles onto a surface of said recording medium;

a single viscosity increasing light irradiator downstream from said at least one recording head in said transport direction, the viscosity increasing light irradiator irradiating said recording medium with a first type of irradiation light that increases the viscosity of said ink; and a fixing light irradiator downstream from said viscosity increasing light irradiator in said transport direction, the fixing light irradiator irradiating said recording medium with a second type of irradiation light that fixes said ink on said recording medium, said first type of irradiation light being smaller in amount of light than said second type of irradiation light, said transport mechanism including a first switching part between said viscosity increasing light irradiator and said fixing light irradiator, the first switching part changing the transport orientation of said recording medium so that the transport orientation becomes the vertical or approaches the vertical, and a second switching part downstream from said fixing light irradiator in said transport direction, the second switching part changing the transport orientation of said recording medium so that the transport orientation approaches the horizontal, said recording medium being transported in such a manner as to cross a line segment connecting said at least one recording head and said fixing light irradiator, said fixing light irradiator emitting said second type of irradiation light toward said recording medium transported in the orientation changed by said first switching part, wherein said at least one recording head includes a plurality of recording heads, and said single viscosity increasing light irradiator is disposed at a location downstream from the most downstream one of said recording heads in said transport direction.

2. The image recording apparatus according to claim 1, wherein said ink is an ultraviolet ray curable ink, and said viscosity increasing light irradiator and said fixing light irradiator emit light including ultraviolet rays.

3. The image recording apparatus according to claim 1, wherein said viscosity increasing light irradiator includes an LED light source, and said first type of irradiation light is emitted from said LED light source.

4. The image recording apparatus according to claim 1, wherein said first switching part changes the transport orientation of said recording medium to a vertical downward orientation.

5. The image recording apparatus according to claim 1, wherein the most downstream one of said recording heads in said transport direction is a recording head for ejecting a black ink.

6. The image recording apparatus according to claim 1, wherein the single viscosity increasing light irradiator is only one viscosity increasing light irradiator in the image recording apparatus.

7. The image recording apparatus according to claim 1, wherein said single viscosity increasing light irradiator is disposed at the location downstream from the most downstream one of all said recording heads in the image recording apparatus in said transport direction.

* * * * *